US005445418A

United States Patent [19]

Blend

[11] Patent Number: 5,445,418

[45] Date of Patent: Aug. 29, 1995

[54] SECURITY PAPER/DOCUMENT CONSTRUCTION

[75] Inventor: Theodore Blend, Buckhannon, W. Va.

[73] Assignee: Moore Business Forms, Inc., Grand Island, N.Y.

[21] Appl. No.: 117,599

[22] Filed: Sep. 8, 1993

[51] Int. Cl.[6] ..... B42D 15/10

[52] U.S. Cl. ..... 283/58; D19/5; D19/11

[58] Field of Search ..... 283/57, 58, 59, 60.1, 283/60.2; D19/5, 9, 10, 11, 12

[56] References Cited

U.S. PATENT DOCUMENTS

| | | | |
|---|---|---|---|
| D. 30,888 | 5/1899 | Parsons . | |
| 36,561 | 2/1863 | Batchelder . | |
| D. 40,362 | 11/1909 | Sergeant . | |
| D. 50,415 | 3/1917 | Gurney . | |
| D. 61,174 | 7/1922 | Meyer . | |
| D. 61,205 | 7/1992 | Meyer . | |
| D. 61,332 | 8/1922 | Shoemaker . | |
| D. 63,912 | 2/1924 | Prizer . | |
| D. 69,180 | 1/1926 | Hotchkiss . | |
| D. 69,396 | 2/1926 | Heterington . | |
| D. 85,997 | 1/1932 | Smith . | |
| D. 96,165 | 7/1935 | Deutsch et al. . | |
| D. 185,622 | 7/1959 | Berg . | |
| D. 185,623 | 7/1949 | Berg . | |
| D. 217,573 | 5/1970 | Couve . | |
| D. 217,574 | 5/1970 | Couve . | |
| D. 217,576 | 5/1970 | Couve . | |
| D. 217,577 | 5/1970 | Couve . | |
| D. 335,502 | 5/1993 | Coe . | |
| 595,281 | 12/1897 | Yetter | 283/114 |
| 1,431,038 | 10/1922 | Prokopovitsh | 283/58 |
| 1,506,144 | 8/1924 | Weeks . | |
| 2,804,821 | 9/1957 | Misuraca | 283/58 |
| 3,112,151 | 11/1963 | Buros | 283/58 |
| 4,614,362 | 9/1986 | Breen et al. | 283/58 |
| 4,681,348 | 7/1987 | Mowry, Jr. . | |
| 4,891,666 | 1/1990 | Gordon . | |
| 5,062,666 | 11/1991 | Mowry et al. | 283/58 |
| 5,093,184 | 3/1992 | Edwards . | |
| 5,178,418 | 1/1993 | Merry et al. . | |

FOREIGN PATENT DOCUMENTS

| | | | |
|---|---|---|---|
| 0680924 | 2/1964 | Canada | 283/58 |
| 92/05521 | 4/1992 | WIPO | 283/57 |

OTHER PUBLICATIONS

U.S. Trademark Reg. 831,080, registered Jun. 17, 1967.

*Primary Examiner*—Hwei Siu Payer
*Attorney, Agent, or Firm*—Nixon & Vanderhye

[57] ABSTRACT

Security paper having a number of parallel lines having a substantially uniform first spacing, irregularly interrupted by a plurality of stripes having a second spacing greater than the first spacing, is flexographically printed on at least one face of a web which becomes, after further processing, a security document such as a bank check. The parallel lines typically are substantially straight and of substantially uniform thickness and formed of flexo ink, such as the type which becomes invisible when bleached. Alphanumeric indicia are preferably provided within the stripes either oriented parallel to the parallel lines (and alternately extending from top to bottom, and bottom to top), or perpendicular to the parallel lines. A pattern is provided that repeats at an interval significantly greater than the length of the security document formed from the security paper. At least one of the faces of the security document, typically the face opposite that having the parallel lines, has readable alphanumeric indicia appropriate for a security document imaged on it. The web on which the flexographic printing and imaging takes place is ultimately cut into individual security documents or sets of security documents, with the interval of a security pattern about 15–17 inches, and the length of the security document about 5.5–12 inches. The web may be taken up and shipped to another location after flexographic printing and tensioning to stretch the pattern, prior to imaging of the security document indicia.

24 Claims, 2 Drawing Sheets

SECURITY PAPER/DOCUMENT CONSTRUCTION

BACKGROUND AND SUMMARY OF THE INVENTION

A common technique that forgerers use in association with negotiable instruments such as bank checks, money orders, stock certificates, titles to personal property, etc., is to cut something from one part of a negotiable document and paste it on another part of that document, or another like document. For a professional forgerer, this technique can be very successful even with many types of conventional types of paper on which the negotiable instrument is printed, typically known as "security paper" or "safety paper". While some techniques are known to minimize this possibility, sometimes such techniques are visually unattractive, and "intrusive" and confusing on the final security document produced. Also the techniques for producing such documents may be complex.

According to the present invention a security paper, security document, and method of production thereof are provided which have a number of advantages. The security paper and security document according to the present invention are very difficult to utilize in forging by the cut and paste method because of the disposition of the particular security elements provided on the security paper/document. While greatly minimizing the possibility of successful cut and paste forgery, the security paper/document according to the invention is unobtrusive, and will not normally be recognized by the user of the security document/negotiable instrument without careful inspection. Further, the method according to the present invention is simple and easy to utilize, and is susceptible to a multitude of easily made variations.

According to one aspect of the present invention, a security paper is provided comprising the a plurality of parallel lines having a substantially uniform first spacing, irregularly interrupted by a plurality of stripes having a second spacing significantly greater than the first spacing. The term "paper" as used in the present specification and claims means typical cellulosic products, cloth products, and/or synthetic products which are typically used for printing, writing, or other imaging of indicia, particularly negotiable instruments. The term "irregularly" as used in the present specification and claims means non-periodically, such as intermittently or randomly.

The parallel lines on the security paper according to the present invention preferably are substantially straight. Also they are preferably of substantially uniform thickness. They may be provided by flexographic printing, utilizing flexo ink, such as the type which becomes invisible if bleach is applied. Also, it is preferred that alphanumeric indicia be provided within the stripes. The alphanumeric indicia may be oriented so that it is parallel to the parallel lines, either all extending in the same direction, or preferably some extending top to bottom while others extend bottom to top. For example the alphanumeric indicia may comprise the word "security", or can be the name of the company supplying the negotiable instrument (e.g. "X Bank Note Co."). Alternatively the alphanumeric indicia may be oriented so that it is perpendicular to the parallel lines.

The first spacing and thickness of the lines may vary widely. One particular example, however, is that the spacing and thickness of the lines is such that about eight lines are provided per centimeter, and the second spacing is typically at least twice as great as the first spacing, e.g. about 0.3 centimeters. For ease of production, e.g. by flexographic printing, the parallel lines interrupted by irregularly spaced stripes may be disposed in a pattern that repeats in an interval significantly greater than the length of the security document formed from the security paper, the interval and length not being evenly divisible. For example the pattern interval may be between about 15–17 inches (e.g. about 16.265 inches), while the length of the security document formed from the security paper is between about 5.5–12 inches (e.g. 11 inches), which would be common for the production of bank checks.

According to another aspect of the present invention a security document having first and second faces, a length, and a width is provided. At least one of the faces has a plurality of parallel lines having a substantially uniform first spacing, irregularly interrupted by a plurality of stripes having a second spacing significantly greater than the first spacing. At least one of the faces has readable alphanumeric indicia appropriate for a security document imaged thereon along the width or length. The parallel lines irregularly interrupted by stripes are disposed in a pattern that does not repeat within the length or width of the faces. The details of the security elements are as described above with respect to the security paper. The security document may be a bank check, money order, stock certificate, bond, car title, or any other type of conventional negotiable instrument.

A method of producing a security document is also provided according to the invention. The method comprises the steps of: (a) Flexographically printing at least a first face of a web of paper, in a relaxed state, with a plurality of substantially uniform thickness parallel lines having a substantially uniform first spacing, irregularly interrupted by a plurality of stripes having a second spacing significantly greater than the first spacing, and having a pattern repeating in a first interval. (b) Tensioning the web to stretch the pattern. (c) Imaging a face of the web with readable alphanumeric indicia appropriate for a security document repeating in a second interval, significantly less than the first interval. And, (d) cutting the web into individual security documents or sets of security documents.

There may be the further steps of taking up the web at a first location after step (b), and transporting it to another location for the practice of steps (c) and (d). Step (a) may be practiced only on the first face of the web and step (c) practiced on only the second face of the web, opposite the first face. Step (a) preferably is also further practiced to prim second alphanumeric indicia within the stripes. Step (c) may be practiced to image indicia for a bank check, and steps (a) through (d) are then typically practiced so that the first interval is between about 15–17 inches, and the second interval is between about 5.5–12 inches.

It is the primary object of the present invention to provide a simple security paper which is effective against cut and paste forgery, is non-intrusive, and despite the fact that it is simply produced, allows construction of security documents without a repeating pattern. This and other objects of the invention will become clear from an inspection of the detailed description of the invention and from the appended claims.

DETAILED DESCRIPTION OF THE DRAWINGS

Figure 1:
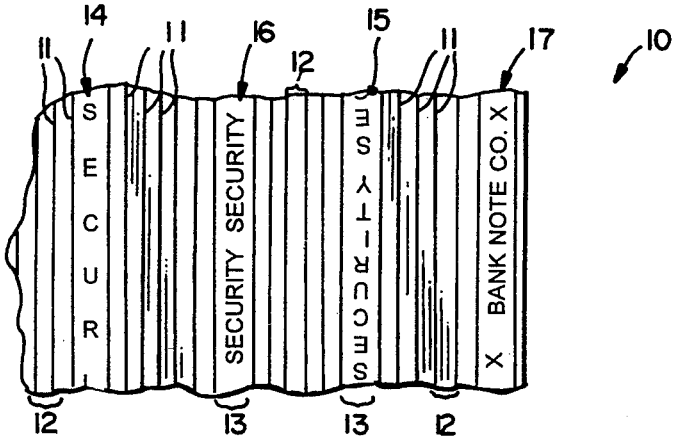
FIG. 1 is a top plan detail view of a portion of a piece of security paper according to the present invention.

A portion of a piece of security paper according to the present invention is shown generally by reference numeral 10 in FIG. 1. It includes a plurality of parallel lines 11 having a substantially uniform first spacing 12 between them. The lines 11 are typically formed by printing, e.g. with flexo ink such as available from Sun Chemical Co., General Printing Ink Division, in North Lake, Ill. For example the flexo ink forming the lines 11 may be that sold under the trade name "Leach and Bleach" which is of a type that disappears if bleach is applied, leaving only the unprinted bleached paper. The lines 11 typically are solid, although they may be discontinuous in some form or another (e.g. screen printed), and typically are of a light color so that they provide a background and are not readily noticeable from a distance. The lines 11 also are typically straight, as illustrated in FIG. 1, although they may have any desired parallel curvatures, and are preferably of uniform thickness.

The lines 11 are interrupted in an irregular manner by a plurality of stripes 13 having a second spacing significantly greater than the first spacing 12. For example if the lines 11 are of substantially uniform thickness, the sum of the thicknesses of the lines 11 and the first spacings 12 is such that about eight lines 11 and spacings 12 may be provided per centimeter. The width of each of the stripes 13, however, is at least twice as great as the spacing 12, for example about 0.3 centimeters for the particular construction set forth above. Of course the thickness of the lines 11, the dimensions of the first spacing 12, and the width of the stripes 13 may vary widely, in fact the stripes 13 need not be of uniform thickness (that is the second spacing between lines 11 forming the stripes 13 may vary).

The number of lines 11 between the stripes 13 is not critical, it is merely important that the stripes 13 be provided irregularly (that is non-periodically, such as intermittently or randomly). For example there may be nine lines 11 between two stripes 13, then seven lines 11, then three lines 11, then eight lines 11, etc., the number of lines 11 between stripes 13 typically varying between two and fifteen, although any number can be provided.

Preferably according to the present invention alphanumeric indicia are provided within the stripes 13. The alphanumeric indicia makes cut and pasting much more difficult for a forger, making it almost impossible to move a "patch" from left to right, or up and down. As indicated by reference numeral 14 in FIG. 1, the alphanumeric indicia may be provided parallel to the lines 11, and preferably comprises a human readable word, such as the word "security" for the indicia 14. Instead of, or alternately with, the indicia 14 may be the indicia 15 which is also parallel to the lines 11, but is "upside down" (that is from bottom to top rather than top to bottom as seen in FIG. 1) with respect to the indicia 14. Also as seen in FIG. 1 the start of the word "security" for indicia 15 is staggered (offset) with respect to the start at the word "security" for indicia 14 in an adjacent stripe 13 (having the same or a different orientation).

In addition to, or instead of, the orientations indicated by reference numerals 14, 15, the alphanumeric indicia 16 may be perpendicular to the lines 11 rather than parallel to it. Also, instead of the word "security" any other alphanumeric indicia that is suitable may be utilized. For example the alphanumeric indicia 17 is the name of the bank note company that utilizes the safety paper 10 (i.e. "X Bank Note Co." in the embodiment illustrated in FIG. 1 ).

Figure 2:
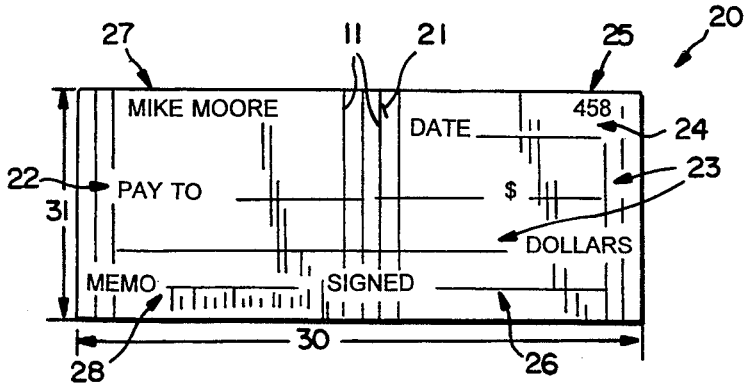
FIG. 2 is a top plan view of a first embodiment of a security document (bank check) produced utilizing the paper of FIG. 1.

The security paper 10 may have the lines 11 interrupted by the stripes 13 on one or both faces thereof, and is utilized to construct a security document, such as the bank check 20 illustrated in FIG. 2 (any security document can be constructed therefrom, such as a money order, bond, stock certificate, title, etc.). The bank check 20 has a face 21 on which the lines 11 are provided (see only faintly in FIG. 2), and additionally has other alphanumeric indicia appropriate for a security document imaged on the face 21. For example this alphanumeric indicia suitable for a security document may be the "pay to" indicia 22, the dollar amount indicia 23, the date indicia 24, the sequential check number indicia 25, signature line indicia 26, the check issuer indicia 27, and the machine readable MICR code indicia 28. The security document 20 has a length 30 and a width 31.

When constructing the security paper 10 of FIG. 1 in order for the construction to be by conventional techniques, and as simple as possible, the lines 11 and stripes 13 will be provided in a pattern - that is they will eventually repeat. However the interval of the pattern for the safety paper 10 is greater than the longest dimension of the security document 20 (the dimension that it will be developed in), in this case longer than the length 30. In this way there is no repeat pattern within a single document 20, and since the interval for the security paper may readily be dimensioned so that it is not evenly divisible by the length 30, almost no two documents 20 will have the same pattern thereon, therefore it will be virtually impossible for a forger to successfully cut and paste from one document to the other.

Figure 3:
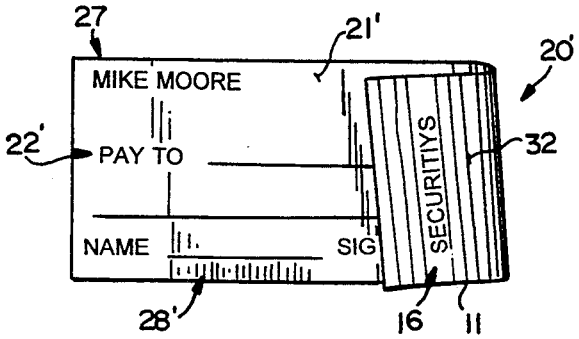
FIG. 3 is a top plan view, with the document curled back to reveal the bottom face thereof, of a second embodiment of a security document according to the invention made from the security paper of FIG. 1.

FIG. 3 shows another embodiment of a bank check 20' according to the present invention, components of the check 20' comparable to those in FIG. 2 being shown by the same reference numeral only followed by a "'". In this particular situation, the front face 21' of the check 20' is not printed with the security indicia 11, 14, etc. but rather only the back face 32 is printed with the security indicia.

Figure 4:
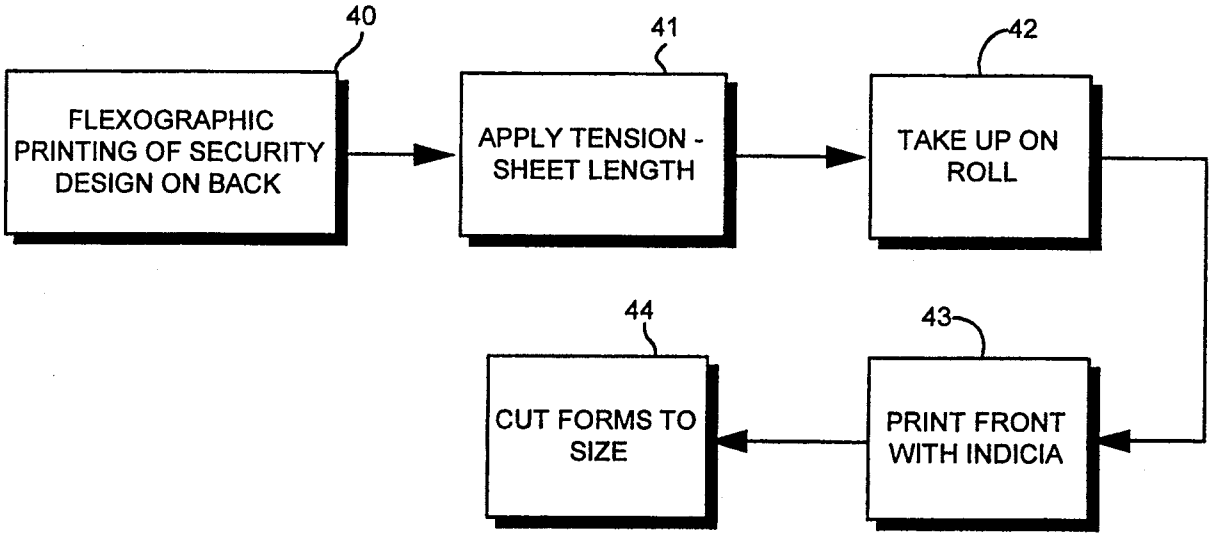
FIG. 4 is a block diagram illustrating various method steps that may be practiced to provide the method of producing a security document according to the present invention.

While different techniques may be utilized for the construction of the security paper 10 and the security documents 20, 20' according to the present invention, one particularly advantageous, simple, procedure that may be utilized is illustrated in FIG. 4. FIG. 4 shows the basic steps of: flexographic printing of the security design on one face of a web of paper as illustrated at 40, applying tension to the web as indicated at 41, taking up the web on a roll as indicated at 42, transporting the roll to another location and then printing or otherwise imaging another face of the web with alphanumeric indicia suitable for a security document as indicated at 43, and then cutting the web to form the individual security documents, or sets of security documents, as illustrated at 44.

For the flexographic printing step 40, typically an engraved sleeve, such as purchased from Luminite Products Corporation of Salamanca, N.Y., is produced having thereon the lines 11, stripes 13, security printing 14, 15, 16 and/or 17, etc. The sleeve is in tubular form and placed over a printing element for a conventional flexographic printing operation, and, for example, has a circumference, for example, of about 15–17 inches (e.g. 16.25 inches). The web of paper is printed by the sleeve at stage 40 in a somewhat relaxed state. As is common in flexographic printing per se, after printing, tension on the web may be increased as indicated at stage 41, causing the pattern illustrated at 10 in FIG. 1 to stretch, i.e. providing "sheet length". For example the pattern may stretch out 1/64th of an inch for every rotation. While it is preferred that the pattern only be printed on one face of the web of paper, it may be printed on both either in aligned, or non-aligned, configurations.

Stage 43 typically takes place on a press or other imaging equipment, such as a standard press for printing security documents such as bank checks, automobile titles, etc. Much of the information printed by the press is static, although obviously variable information (such as sequential numbering of checks, titles, or the like may be provided) may be provided too, as is conventional. Preferably the printing occurs on the opposite face of the security indicia, as illustrated in the final check 20' illustrated in FIG. 3 (see faces 21' and 32). The printing of the security document at 43 is at a different interval than the interval provided by the stages 40, 41. That is, if the pattern of the security information as illustrated at 10 is 16.265 inches (16.25 inches is the circumference of the engraved sleeve, and 1/64th inch "stretching" for each rotation), then the pattern interval for the checks or other security documents printed at 43 is not evenly divisible into the first interval, e.g. a second interval of about 5.5–12 inches (e.g. typically either six or 11 inches if a check is being printed) is practiced at stage 43. After printing of the check indicia, such as 22 through 28 illustrated in FIG. 2, the security documents are then cut to size at 44 in a conventional cutting operation, e.g. being cut into individual check lengths, or sets of checks (e.g. three, per set, one on top of the other), with or without stubs.

It will thus be seen that the security document 20, 20' produced according to the invention is difficult to forge by cut and paste since it is almost impossible to find an appropriate match by moving the security indicia as illustrated in FIG. 1 either up, down, left, or right in view of all of the following: The irregular spacing of the stripes 13; the provision of the alphanumeric indicia 14, 15, 16 and/or 17; the spacing and location of the indicia components 14–17 with respect to each other; the fact that the pattern provided by the security elements 10 is greater than the length 30 of the document 20; and the fact that the interval provided by the elements 10 is not evenly divisible by the length 30 of the document 20, 20' produced thereby.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A security document having first and second faces, a length, and a width;

at least one of said faces having a plurality of parallel lines having a substantially uniform first spacing between two adjacent lines, irregularly interrupted by a plurality of stripes each having a width defining a second spacing significantly greater than said first spacing; and at least the other of said faces having readable alphanumeric indicia appropriate for a security document imaged thereon along said width or length; and wherein said parallel lines irregularly interrupted by said stripes are disposed in a pattern that does not repeat within said length or width, and are disposed over substantially the entire of said at least one of said faces.

2. A security document as recited in claim 1 wherein said plurality of parallel lines irregularly interrupted by said stripes is disposed on said first face, and said readable alphanumeric indicia is imaged on said second face.

3. A security document as recited in claim 2 further comprising second alphanumeric indicia provided within said stripes, and wherein said lines are substantially straight and have substantially uniform thickness.

4. A security document as recited in claim 1 further comprising second alphanumeric indicia provided within said stripes, and wherein said lines are substantially straight and have substantially uniform thickness.

5. A security document as recited in claim 4 wherein the second alphanumeric indicia is oriented so that it is parallel to said parallel lines.

6. A security document as recited in claim 5 wherein the second alphanumeric indicia comprises the word "security", and is oriented so that in some stripes it extends from top to bottom, and in other stripes from bottom to top, and is offset from one stripe to another.

7. A security document as recited in claim 4 wherein the pattern has a pattern interval, and wherein the pattern interval and the length of the faces are not evenly divisible.

8. A security document as recited in claim 4, wherein the second alphanumeric indicia is oriented so that it is perpendicular to said parallel lines.

9. A security document as recited in claim 8 wherein the second alphanumeric indicia comprises the word "security", and is oriented so that in some stripes it extends from top to bottom, and in other stripes from bottom to top, and is offset from one stripe to another.

10. A security document as recited in claim 1 wherein the pattern has a pattern interval, and wherein the pattern interval and the length of the faces are not evenly divisible.

11. A security paper comprising a plurality of parallel lines having a substantially uniform first spacing between two adjacent lines, irregularly interrupted by a plurality of stripes each having a width defining a second spacing significantly greater than said first spacing; and alphanumeric indicia provided within said stripes.

12. A security paper as recited in claim 1 wherein said parallel lines are substantially straight, and of substantially uniform thickness.

13. A security paper as recited in claim 2 wherein the alphanumeric indicia is oriented so that it is parallel to said parallel lines.

14. A security paper as recited in claim 2 wherein the alphanumeric indicia comprises the word "security", and is oriented so that in some stripes it extends from top to bottom, and in other stripes from bottom to top, and so that it is offset from one stripe to the next.

15. A security paper as recited in claim 12 wherein the first spacing and thickness of the lines is such that about eight lines are provided per centimeter, and wherein said second spacing is about 0.3 centimeters.

16. A security paper as recited in claim 1 wherein said lines are defined by flexo ink.

17. A security paper as recited in claim 1 wherein the alphanumeric indicia is oriented so that it is perpendicular to said parallel lines.

18. A security paper as recited in claim 1 wherein said lines and said alphanumeric indicia are defined by flexo ink.

19. A security paper as recited in claim 1 wherein the alphanumeric indicia is oriented so that it is parallel to said parallel lines.

20. A security paper as recited in claim 19 wherein the alphanumeric indicia comprises the word "security", and is oriented so that in some stripes it extends from top to bottom, and in other stripes from bottom to top, and so that it is offset from one stripe to the next.

21. A security paper comprising a plurality of parallel lines having a substantially uniform first spacing between two adjacent lines, irregularly interrupted by a plurality of stripes each having a width defining a second spacing significantly greater than said first spacing; and said lines being defined by flexo ink.

22. A security paper as recited in claim 21 wherein the flexo ink is of a type which becomes invisible if bleach is applied.

23. A security paper as recited in claim 21 further comprising alphanumeric indicia provided within said stripes.

24. A security document web comprising:

a web of security paper comprising a plurality of parallel lines having a substantially uniform first spacing between two adjacent lines, irregularly interrupted by a plurality of stripes each having a width defining a second spacing significantly greater than said first spacing, said parallel lines and stripes being disposed in a pattern; and wherein said pattern repeats every 16.25 inches.

* * * * *